US007106985B2

(12) United States Patent
Sone et al.

(10) Patent No.: US 7,106,985 B2
(45) Date of Patent: Sep. 12, 2006

(54) IMAGE FORMING SYSTEM HAVING A TEMPERATURE CONTROLLED FIXING UNIT

(75) Inventors: Toshihiro Sone, Yokohama (JP); Osamu Takagi, Chofu (JP); Satoshi Kinouchi, Tokyo-To (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/820,138

(22) Filed: Apr. 8, 2004

(65) Prior Publication Data

US 2005/0226645 A1 Oct. 13, 2005

(51) Int. Cl.
*G03G 15/20* (2006.01)
*G03G 21/20* (2006.01)

(52) U.S. Cl. ..... 399/69; 399/92

(58) Field of Classification Search ..... 399/69, 399/92, 98, 328

See application file for complete search history.

(56) References Cited

U.S. PATENT DOCUMENTS 5,819,136 A * 10/1998 Tomita et al. ..... 399/69
5,915,147 A * 6/1999 Kouno et al. ..... 399/69
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,337,969 B1 1/2002 Takagi et al.
6,408,159 B1 * 6/2002 Ishizuka et al. ..... 399/325
6,415,128 B1 7/2002 Takagi et al.
6,438,335 B1 8/2002 Kinouchi et al.
6,603,938 B1 * 8/2003 Tsubakimoto ..... 399/92
6,643,476 B1 11/2003 Kinouchi et al.
6,643,491 B1 11/2003 Kinouchi et al.
6,654,571 B1 * 11/2003 Nanataki et al. ..... 399/69
6,684,037 B1 * 1/2004 Tamaoki ..... 399/69
6,724,999 B1 4/2004 Kikuchi et al.
6,725,000 B1 4/2004 Takagi et al.

(Continued)

FOREIGN PATENT DOCUMENTS

JP 10-39676 A 2/1998

(Continued)

OTHER PUBLICATIONS

U.S. Appl. No. 10/799,770, filed Mar. 15, 2004, Kikuchi et al.

(Continued)

*Primary Examiner*—Sandra L. Brase
(74) *Attorney, Agent, or Firm*—Foley & Lardner LLP

(57) ABSTRACT

An image forming system has: a manuscript image reading device to scan a manuscript and obtain shade information on the manuscript; an exposure/development device to record a charged latent image in a photosensitive body based on the shade information obtained by said manuscript image reading device, to apply toners to the photosensitive body to transfer the toners to a recording medium; and a fixing device to fix the toners transferred to the recording medium by thermal pressing; said fixing device having a rotational heating member; a pressing roller for pressing from a bottom of the rotational heating member; and a non-contact temperature detector provided above a horizontal surface passing a rotation axis of the rotational heating member, which detects a temperature of said rotational heating member; wherein heating of the rotational heating member is controlled by a value detected by said non-contact temperature detector.

10 Claims, 8 Drawing Sheets

U.S. PATENT DOCUMENTS

| | | | | |
|---|---|---|---|---|
| 6,763,206 | B1 | 7/2004 | Kinouchi et al. | |
| 6,795,680 | B1 * | 9/2004 | Yokoi et al. | 399/69 X |
| 6,816,699 | B1 * | 11/2004 | Katayanagi et al. | 399/328 X |
| 2003/0086718 | A1 * | 5/2003 | Birumachi | 399/67 |
| 2003/0219271 | A1 | 11/2003 | Kinouchi et al. | |
| 2004/0086295 | A1 * | 5/2004 | Peng et al. | 399/69 |
| 2004/0141038 | A1 | 7/2004 | Takagi et al. | |
| 2004/0169895 | A1 | 9/2004 | Hashizume et al. | |
| 2004/0173603 | A1 | 9/2004 | Kinouchi et al. | |
| 2004/0175211 | A1 | 9/2004 | Sone et al. | |
| 2004/0175212 | A1 | 9/2004 | Tsueda et al. | |
| 2004/0179874 | A1 | 9/2004 | Kinouchi et al. | |
| 2004/0184852 | A1 | 9/2004 | Takagi et al. | |
| 2004/0188421 | A1 | 9/2004 | Takagi et al. | |
| 2004/0188422 | A1 | 9/2004 | Wasai et al. | |
| 2004/0238531 | A1 | 12/2004 | Kikuchi et al. | |
| 2004/0265021 | A1 | 12/2004 | Kinouchi et al. | |

FOREIGN PATENT DOCUMENTS

| | | | |
|---|---|---|---|
| JP | 2000-315034 A | | 11/2000 |
| JP | 2001-034109 | * | 2/2001 |
| JP | 2004-045330 | * | 2/2004 |

OTHER PUBLICATIONS

U.S. Appl. No. 10/805,522, filed Mar. 22, 2004, Kikuchi et al.
U.S. Appl. No. 10/805,514, filed Mar. 22, 2004, Kinouchi et al.
U.S. Appl. No. 10/805,308, filed Mar. 22, 2004, Tsueda et al.
U.S. Appl. No. 10/805,507, filed Mar. 22, 2004, Kikuchi et al.
U.S. Appl. No. 10/805,420, filed Mar. 22, 2004, Sone et al.
U.S. Appl. No. 10/805,305, filed Mar. 22, 2004, Sone et al.

* cited by examiner

IMAGE FORMING SYSTEM HAVING A TEMPERATURE CONTROLLED FIXING UNIT

BACKGROUND OF THE INVENTION

This invention relates to an image forming system, and particularly to a temperature control of the image forming system.

In an image forming system, a latent image which corresponds to an image of a manuscript is formed in a photosensitive material formed on a photosensitive drum, toners are absorbed to the photosensitive material, then the toners are transferred to a recording medium such as a paper, and further the toners are thermally fixed by heating means to obtain a transcribed image.

In order to perform such thermal fixing, in the image forming system, there is usually provided a fixing unit which includes a fixing roller having a smooth surface and heating means, a pressing roller to press a paper to be transcribed against the fixing roller. Papers to which toners are transferred are passed between the fixing roller and the pressing roller.

Temperature control for the fixing roller is extremely important to obtain quality transcribed images.

For this purpose, the following prior arts are known.

The first one is disclosed in Japanese Patent Laid-open Publication No. 2000-315034, which provides a first temperature detecting means for detecting surface temperature of the fixing roller; a first controlling means for ON/OFF controlling of a first heating means for heating the fixing roller to maintain a setting temperature in response to the detection result of the first temperature detecting means; a non-contact heat supply means having a second heating means for heating and melting the image toners on the paper; a second temperature detecting means for detecting temperature of said second heating means, and a second controlling means for ON/OFF controlling said second heating means at a setting temperature in response to the detection result of the first temperature detecting means so that the temperature of said non-contact heat supply means has a predetermined relation with the surface temperature of said fixing roller.

However, if the first temperature detecting means used here is of the type that touches the fixing roller, there might be a trace of the first temperature detecting means on the fixed image. Furthermore, since toners easily attach to this first temperature detecting means and the second temperature detecting means which detects the temperature of the non-contact heat supply means, it is difficult to precisely control the fixing temperature. Still further, if the second temperature detecting means is located above the heating rollers, the temperature detected will rise and the temperature will be detected incorrectly due to heat convection.

The second prior art is disclosed in Japanese Patent Laid-open publication No. 10-39676 (1998), in which the fixing unit is constructed of a cylinder member having a core and an exciting coil wound on the core, and a heat detecting means which detects temperature is provided at an opposite position with the cylinder member being disposed between the exciting coil and the detecting means.

In this prior art, there are still problems that toners may attach to the heat detecting means, and in the case where its position is above the heating roller, temperature may be incorrectly detected due to heat convection.

SUMMARY OF THE INVENTION

According to a first aspect of the present invention, there is provided an image forming system comprising:

a manuscript image reading device to scan a manuscript and obtain shade information on the manuscript;

an exposure/development device to record a charged latent image in a photosensitive body based on the shade information obtained by said manuscript image reading device, to apply toners to the photosensitive body to transfer the toners to a recording medium; and a fixing device to fix the toners transferred to the recording medium by thermal pressing;

said fixing device having a rotational heating member;

a pressing roller for pressing from a bottom of the rotational heating member; and a non-contact temperature detector provided above a horizontal surface passing a rotation axis of the rotational heating member, which detects a temperature of said rotational heating member;

wherein heating of the rotational heating member is controlled by a value detected by said non-contact temperature detector.

According to a second aspect of the present invention, there is provided an image forming system comprising:

a manuscript image reading device to scan a manuscript and obtain shade information on the manuscript;

an exposure/development device to record a charged latent image in a photosensitive body based on the shade information obtained by said manuscript image reading device, to apply toners to the photosensitive body to transfer the toners to a recording medium; and a fixing device to fix the toners transferred to the recording medium by thermal pressing;

said fixing device having a rotational heating member;

a pressing roller for pressing from a bottom of the rotational heating member; and a non-contact temperature detector provided above a horizontal surface passing a rotation axis of the rotational heating member, which detects a temperature of said rotational heating member;

a heat convection direction change means to direct heat convection generated by said rotational heating member to directions other than the direction of said non-contact temperature detector wherein heating of the rotational heating member is controlled by a value detected by said non-contact temperature detector.

According to a third aspect of the present invention, there is provided an image forming system comprising:

a manuscript image reading device to scan a manuscript and obtain shade information on the manuscript;

an exposure/development device to record a charged latent image in a photosensitive body based on the shade information obtained by said manuscript image reading device, to apply toners to the photosensitive body to transfer the toners to a recording medium; and a fixing device to fix the toners transferred to the recording medium by thermal pressing;

said fixing device having a rotational heating member;

a pressing roller for pressing from a bottom of the rotational heating member; and a non-contact temperature detector provided above a horizontal surface passing a rotation axis of the rotational heating member, which detects a temperature of said rotational heating member; and a covering member provided above said non-contact temperature detector, to prevent substances falling from said rotating heating member from attaching to said non-contact temperature detector.

DESCRIPTION OF THE INVENTION

Some of embodiments of the present invention will now be explained with reference to the attached drawings.

Figure 1:
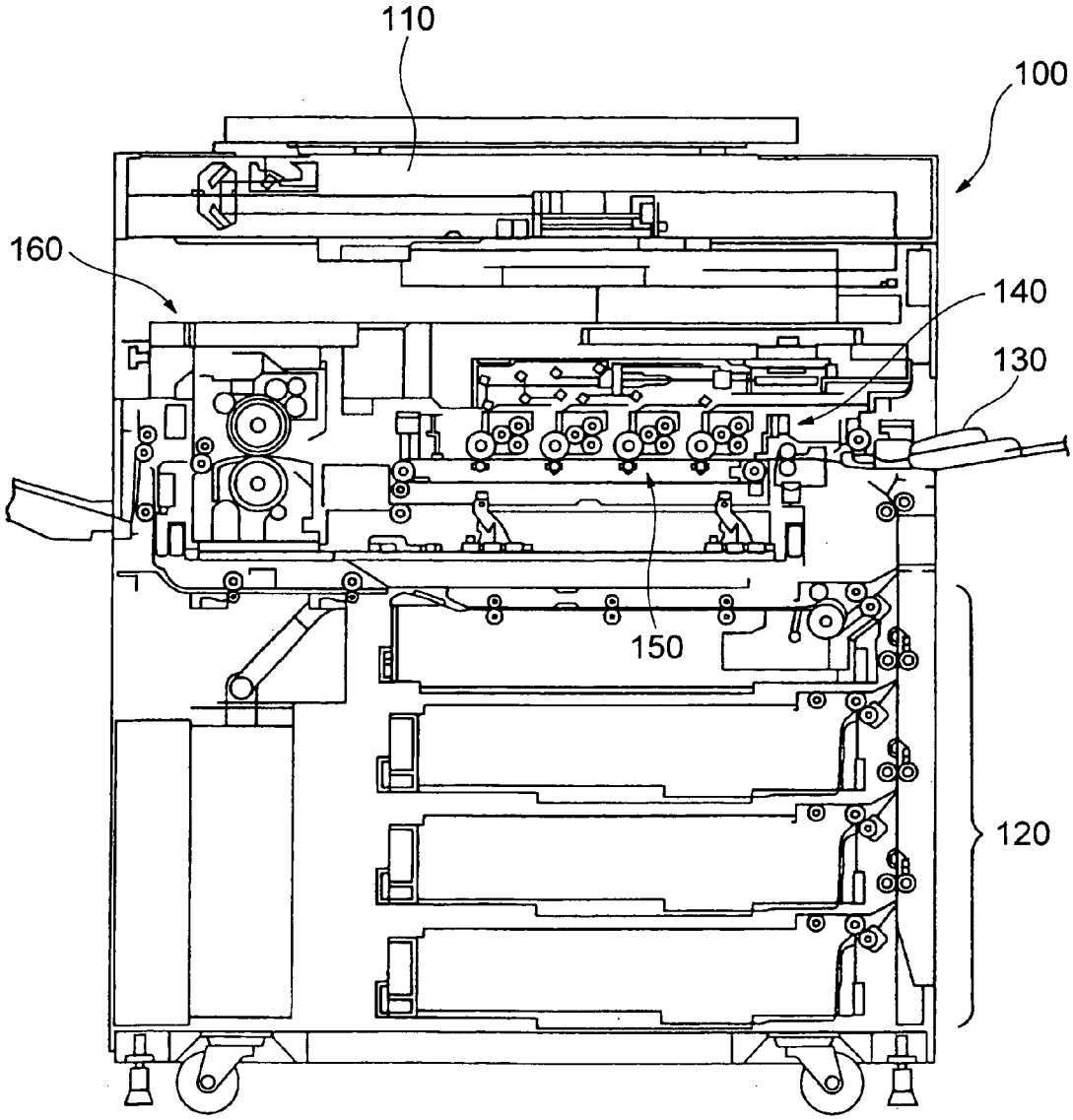
FIG. 1 is a front view showing schematically a structure of a copying machine as one example of an image forming system according to the present invention.

FIG. 1 is a front view showing schematically a structure of a tandem type color copying machine as one example of an image forming system according to the present invention, with its front cover removed.

The image forming system 100 shown in FIG. 1 has an image input unit 110 to read a manuscript, which has e.g. an optical system and is provided at the upper part of the main body; a paper feed cassette device 120 which stores a plurality of kinds of papers in order to feed a lot of papers of a same size and is provided at the lower part of the main body; a manual paper feed device 130 which enables manually feeding various kinds and sizes; an image forming unit 140 which carries an optical image focused by the image input unit as a latent image and forms an image by developing the carried latent image using a developing agent; a transfer unit 150 to transfer the formed image to a fed paper P; and a fixing unit 160 to fix the transferred image.

The image transferred to the paper P by the image forming unit 140 and the transfer unit 150 is supplied to the fixing unit 160 and fixed.

Figure 2:
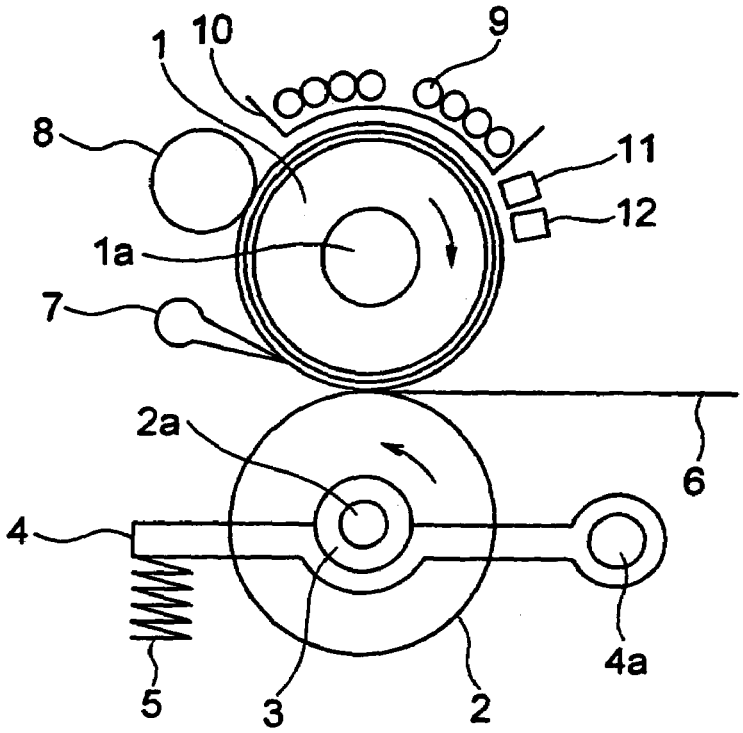
FIG. 2 is a schematic front view showing a principal part in a structure of a fixing device according to an embodiment of the present invention.

FIG. 2 is a front view schematically showing a principal part in a structure of an example of fixing unit 160.

This fixing unit 160 has a heating (fixing) roller 1 having a diameter of 40 mm and a pressing roller 2 which opposes to the heating roller 1 and presses an image transferred paper 6, passing between the heating roller and the pressing roller, against the heating roller. The heating roller is driven by a drive motor (not shown) in a clockwise direction with the rotating axis 1*a* as a rotation center and the position of the rotating axis 1*a* is fixed. On the other hand, an axis 2*a* of the pressing roller 2 is secured to a support arm 4 by means of a bearing 3. One end of the support arm is a rotating axis and at a lower side of another end, a compressing spring 5 is secured. Accordingly, the pressing roller 2 touches the heating roller 1 with a pressure exited by the compressing spring 5 and rotates in an opposite direction.

By passing the paper 6 through a fixing point which is a contact portion (nipping portion) of the heating roller 1 and the pressing roller 2, toners on the paper 6 are fused and pressed to complete fixing.

On the cylindrical surface of the heating roller, a separating blade 7 to separate the paper 6 from the heating roller 1 is provided at the downstream side from the contact point of the heating roller 1 and the pressing roller 2 in the rotating direction. However, the separating blade is not always necessary if the paper 6 can be easily separated from the heating roller 1 in the case that such material is used on the surface of heating roller. On the contrary, if the paper easily sticks and its separation is difficult, a plurality of separating blades can be provided.

A cleaning roller 8 as a cleaning member to remove scattered toners, paper chips and dust is provided at the far rotation point of the heating roller 1. This is provided for preventing deterioration of images because if the toners are on the heating roller, the toners may be transferred and fixed on the paper at the fixing.

Furthermore, the cleaning member should be positioned at the upstream side of the non-contact temperature detector. This is because if the toners stuck on the heating roller reach the non-contact temperature detector, the toners may stick to the non-contact temperature detector 12 and erroneous detection may occur.

As a cleaning member, any member which can effectively remove the toners and other dusts on the surface of the heating roller other than the cleaning roller shown in this figure, such as a cleaning blade, can be employed.

Above the heating roller, there is provided an induction heating device 9 which generates a high frequency a.c. electric field against metal material in the heating roller 1. This induction heating device 9 is shielded by a shielding member 10 which is made by a material that can magnetically shield and does not generate eddy current. This prevents the sensor from heating by the effect of the induction heating as described later. The power of the induction heating device may be around 1300 W, but it is not limited to this value.

Furthermore, at a further point in the rotating direction, there is provided a thermostat 11 to detect abnormality of surface temperature of the heating roller 1 and stop the heating, and a non-contact temperature detector 12 to detect a temperature of the heating roller 1.

Figure 3:
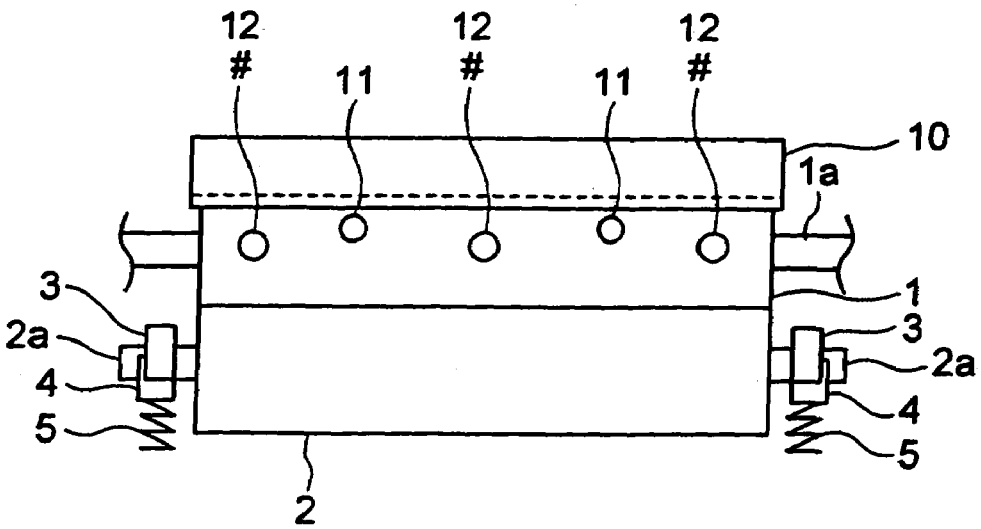
FIG. 3 is a schematic side view from the right side of the structure of FIG. 2.

FIG. 3 is a side view of the fixing device shown in FIG. 2, viewed from the right side and perpendicular to the rotating axis.

As shown in FIG. 3, in the periphery of the heating roller 1, two thermostats 11 and three non-contact temperature detectors 12 are disposed alternately in parallel with the direction of the rotation axis 1*a*. The numbers of them can be arbitrarily selected. By increasing the number thereof, temperature distribution along the whole length of the heating roller can be detected so that more precise temperature control will be realized. However, as control itself will become more complicated and the cost will be increased, the number of the detectors is determined to an appropriate number.

According to this embodiment, the height position of the non-contact temperature detector 12 is approximately to the center position of the rotation axis 1*a*, but the height position of the thermostat 11 is a little bit higher than that of the temperature detector. Such relation is employed to promptly detect abnormality and to enhance safety, but the heights of the two components can be the same position depending on the temperature increasing characteristics, etc. A little bit above the thermostat 11, there is provided a shielding member 10 of the induction heating device.

Next, positional relation of the temperature detector will be explained.

In general, because the non-contact temperature detector is not directly applied, it can correctly detect the temperature regardless of the positional relation with the heating roller. However, since ambient air heated by the heating roller will convect, if the non-contact temperature detector is provided in the air convection area, the detector will detect higher temperature than the actual temperature.

Consequently, according one embodiment of the present invention, in order to avoid the air convection area, the non-contact temperature detector 12 is provided at a position which is apart from the heating roller 1 by 5 mm or more.

Furthermore, in general, some toners generated by defective fixing are stuck to the heating roller, and the toners may fall during its rotation. Since the fall of toners will begin when the surface of the heating roller 1 is lower than a horizontal plane running through the center of the rotation axis, in order not to contaminate the non-contact temperature detector, the detector should be disposed in a region higher than the horizontal plane running through the center of the rotation axis. It should also be disposed within the range having an inclination angle of 45 degree or less. Because air convection will occur in the ambient of the heating roller and in the region having an inclination angle of 45 degree or more, the detector may incorrectly detect temperature.

Accordingly, by disposing the non-contact temperature detector in the area higher than the surface running through the center of the rotation axis of the heating roller, the prevention of toner sticking to the non-contact temperature detector will result in accurate detection of temperature and enhanced fixing performance.

Furthermore, by disposing the non-contacting temperature detector apart from the heating roller 5 by 5 mm or more, and in a range having an inclination angle of 45 degree or less from the horizontal plane running through the center of the rotation axis, the effect of air convection can be eliminated and it is possible to detect temperature quickly, stably and correctly and to obtain enhanced fixing performance and shortened warm-up time, etc.

Still further, by disposing the non-contact temperature detector in the downstream side of the cleaning means, contamination by toners will be prevented, resulting in more precise temperature detection and enhanced fixing performance.

Figure 4:
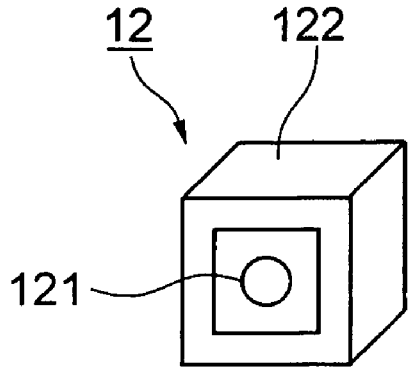
FIG. 4 is a perspective view showing an example of a non-contact temperature detector.

FIG. 4 is a perspective view showing a non-contact temperature detector 12 used in the embodiment shown in FIGS. 2 and 3.

This detector has a rectangular shape as a whole, and the temperature sensor 121 such as a thermistor is shielded by a shielding member 122 of a material that can magnetically shield and does not generate eddy current in order to prevent the sensor from heating by itself by the effect of the induction heater. Aluminum, core material and silicon steel sheet are used as such materials.

Figure 5:
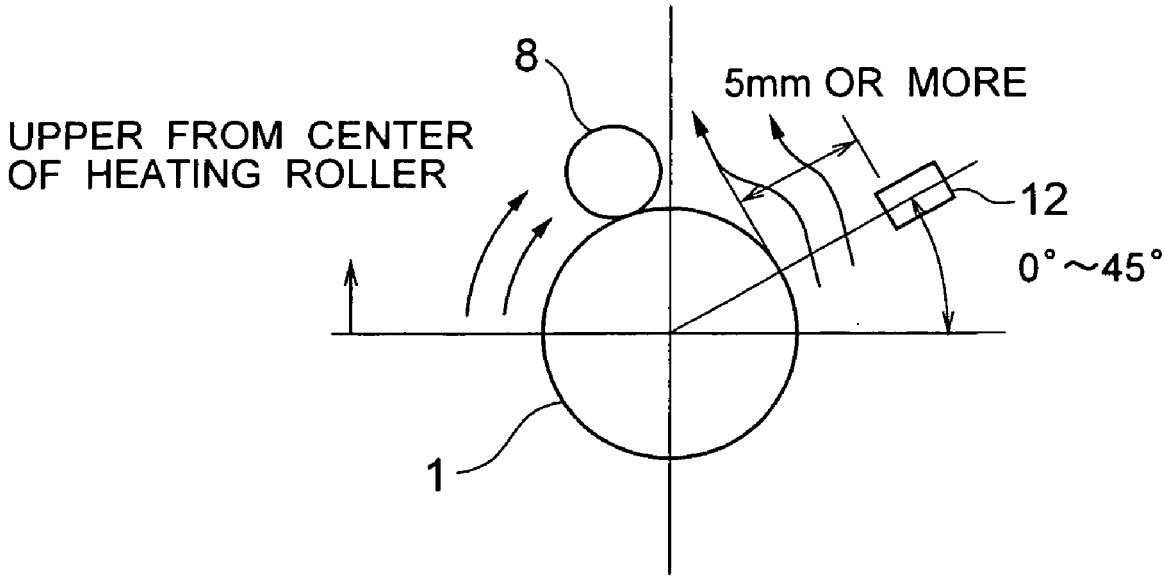
FIG. 5 is an explanatory diagram showing features of the fixing device according to one embodiment of the present invention.

FIG. 5 is an explanatory diagram showing features of the fixing device according to one embodiment of the present invention.

First of all, the non-contact temperature detector is disposed at a higher position than the center position of the heating roller 1 in order not to be adversely affected by the falling of toners stuck to the heating roller 1, and its disposing range is within 45 degrees, with the center of the heating roller 1 used as reference.

Furthermore, the non-contact temperature detector 12 is disposed as being apart from the heating roller 1 by 5 mm or more.

Still further, in order to prevent the non-contact temperature detector 12 from contamination by toners, the cleaning roller 8 is provided at the upstream side of the non-contact temperature detector 12 along the rotating direction.

By employing such construction, contamination by toners and heat transportation of heat generated by the heating roller by air convection are eliminated and accurate and stable operation is made possible.

Figure 6:
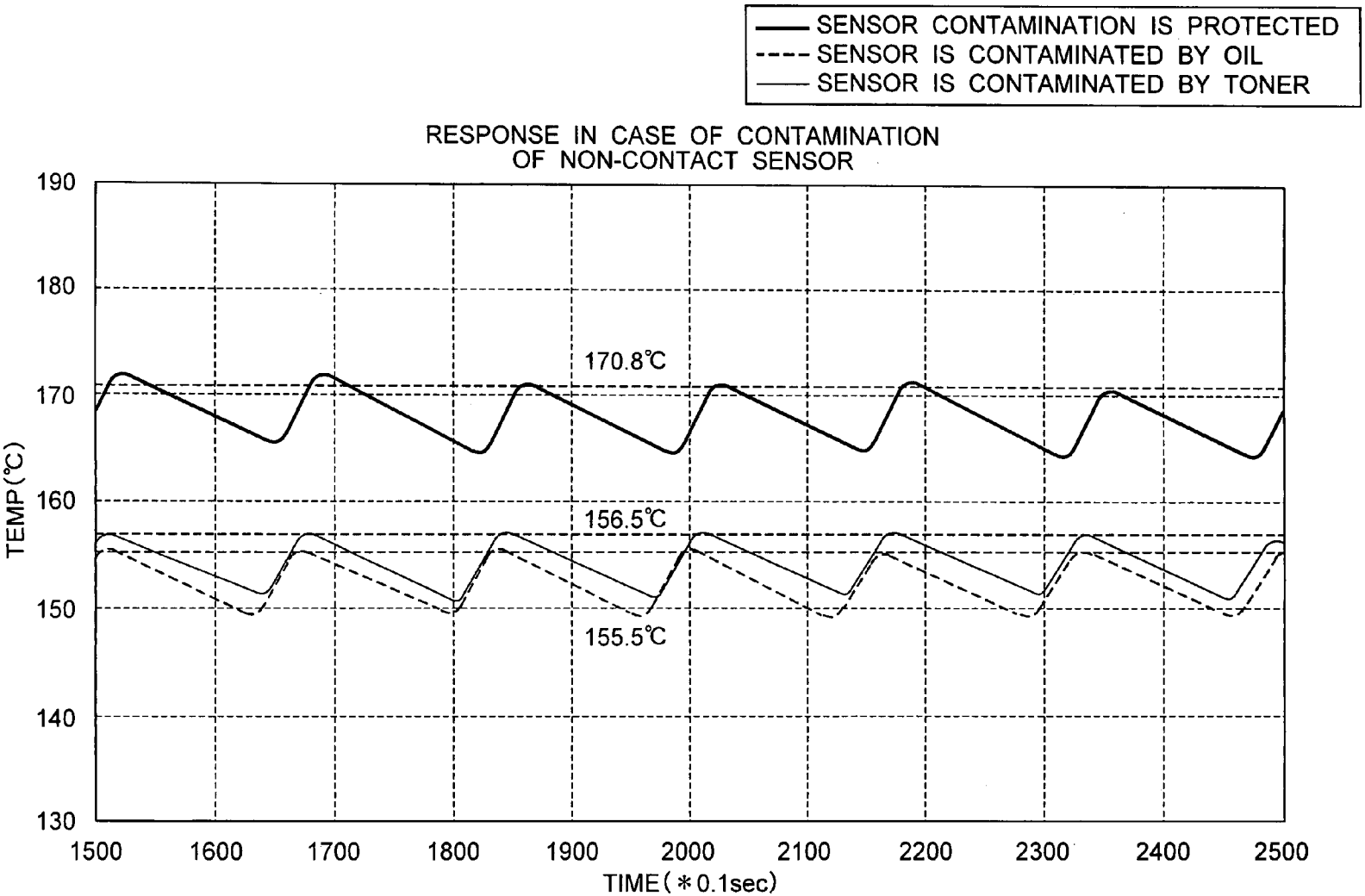
FIG. 6 is a graph showing the difference in output characteristics of the non-contact temperature detector for the cases with or without contamination.
Figure 7:
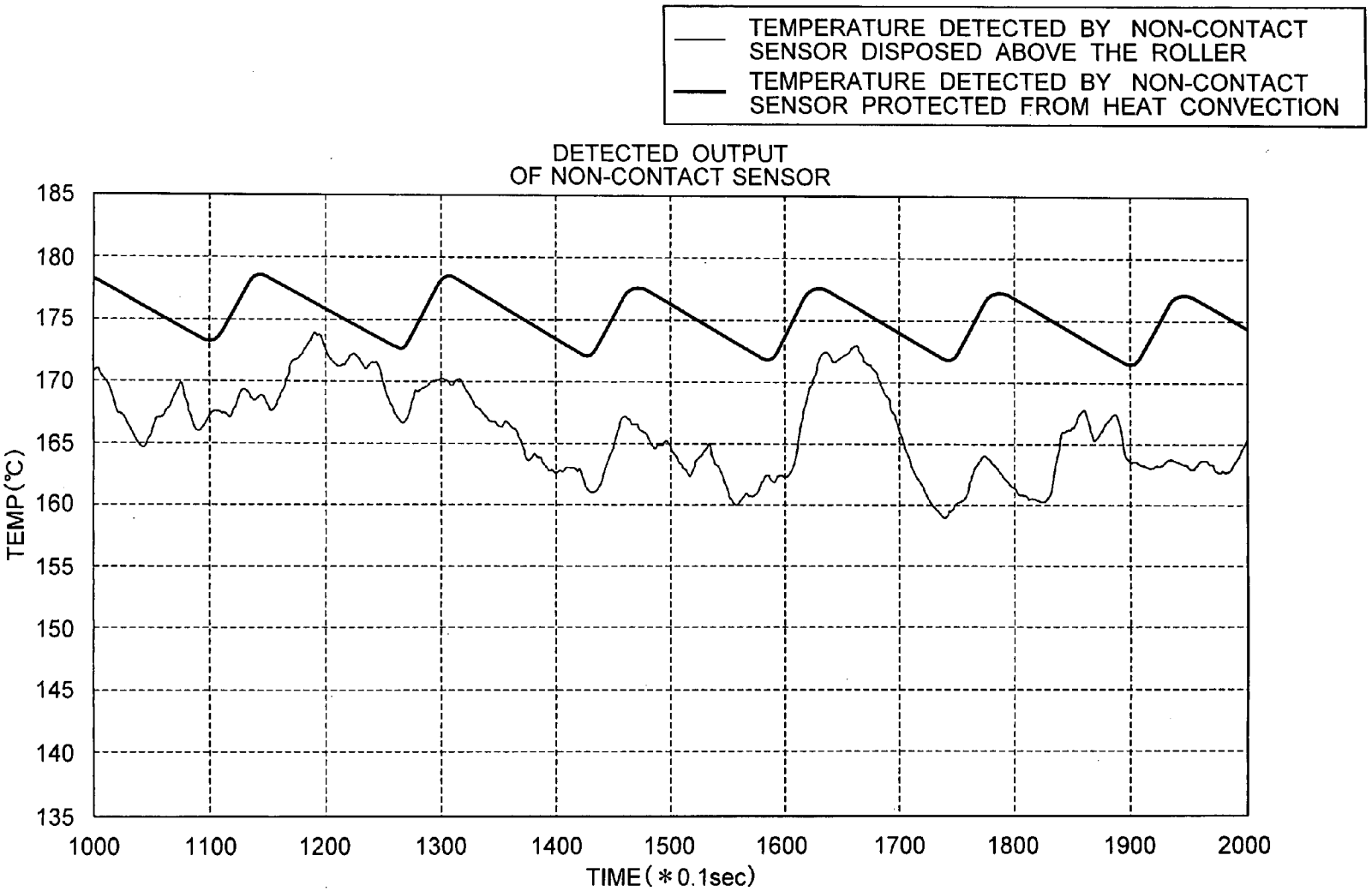
FIG. 7 is a graph showing the difference in output characteristics of the non-contact temperature detector with or without consideration of heat convection.

FIG. 6 and FIG. 7 are graphs showing the effects when the above-mentioned various measures are employed.

FIG. 6 is a graph showing the effect of disposing the non-contact temperature detector in the upper region from the height position of the center of the heating roller, when compared to cases where no countermeasures are employed and the detector is contaminated by oil and toner.

From this graph, it is understood that by preventing the detector from being contaminated, the lowering the detector temperature caused by the contamination can be eliminated.

FIG. 7 is a graph showing the detected temperature value of the non-contact temperature detector when the detector is separated from the heating roller by at least 5 mm in order to avoid the influence of convection from the heating roller compared with the detected value of the heating temperature when it is closely disposed.

From this graph, it is understood that in the conventional close arrangement, these are temperature variations due to heat convection, but according to the embodiment of the present invention, stable temperature detection is realized by eliminating temperature variations due to heat convection.

Figure 8:
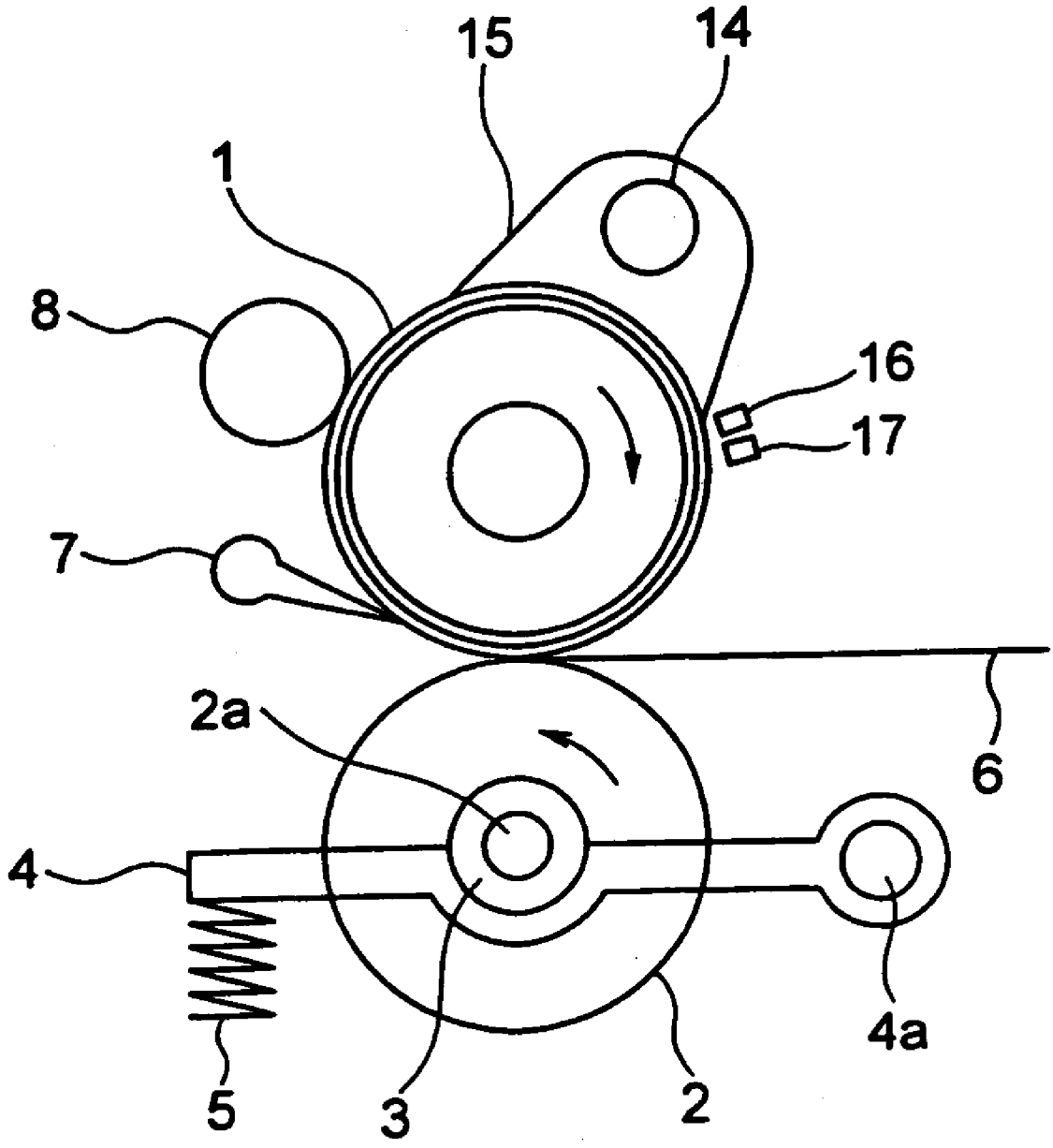
FIG. 8 is a schematic front view showing a principal part in a structure of a fixing device according to a variation of the embodiment of the present invention shown in FIG. 2.

FIG. 8 is a structural diagram showing a variation of the fixing device shown in FIG. 2, and the same reference numerals are applied to the same elements as shown in FIG. 2 and their detailed explanation will be omitted.

In the embodiment, as the heating means, an infrared ray lamp is used instead of the induction heating. The infrared ray lamp 14 is provided above the heating roller and in its periphery, a cover 15 having a reflecting mirror on the inner surface is provided to improve heat efficiency. Curvature and position of the reflecting mirror on the inner surface of the cover 15 are determined so that the light from the infrared ray lamp 14 is converged to the surface of the heating roller 1.

Such heating using the infrared ray lamp is locally performed, but the same phenomenon is observed that by rotating the heating roller clockwise, the heated portion moves to a contact point of the heating roller and the pressing roller and ambient air convection is generated. Accordingly, similar to the embodiment shown in FIG. 2, a thermostat 16 and the non-contact temperature detector 17 are disposed in an area higher that the center position of the heating roller and within a 45 degree range with the center position being the reference. However, in this embodiment, since there is no induction heating means and there is no adverse effect for the thermostat 16 and the non-contact temperature detector 17, the thermostat 16 and the non-contact temperature detector 17 are non-shield type, but shielded type may be used.

Figure 9:
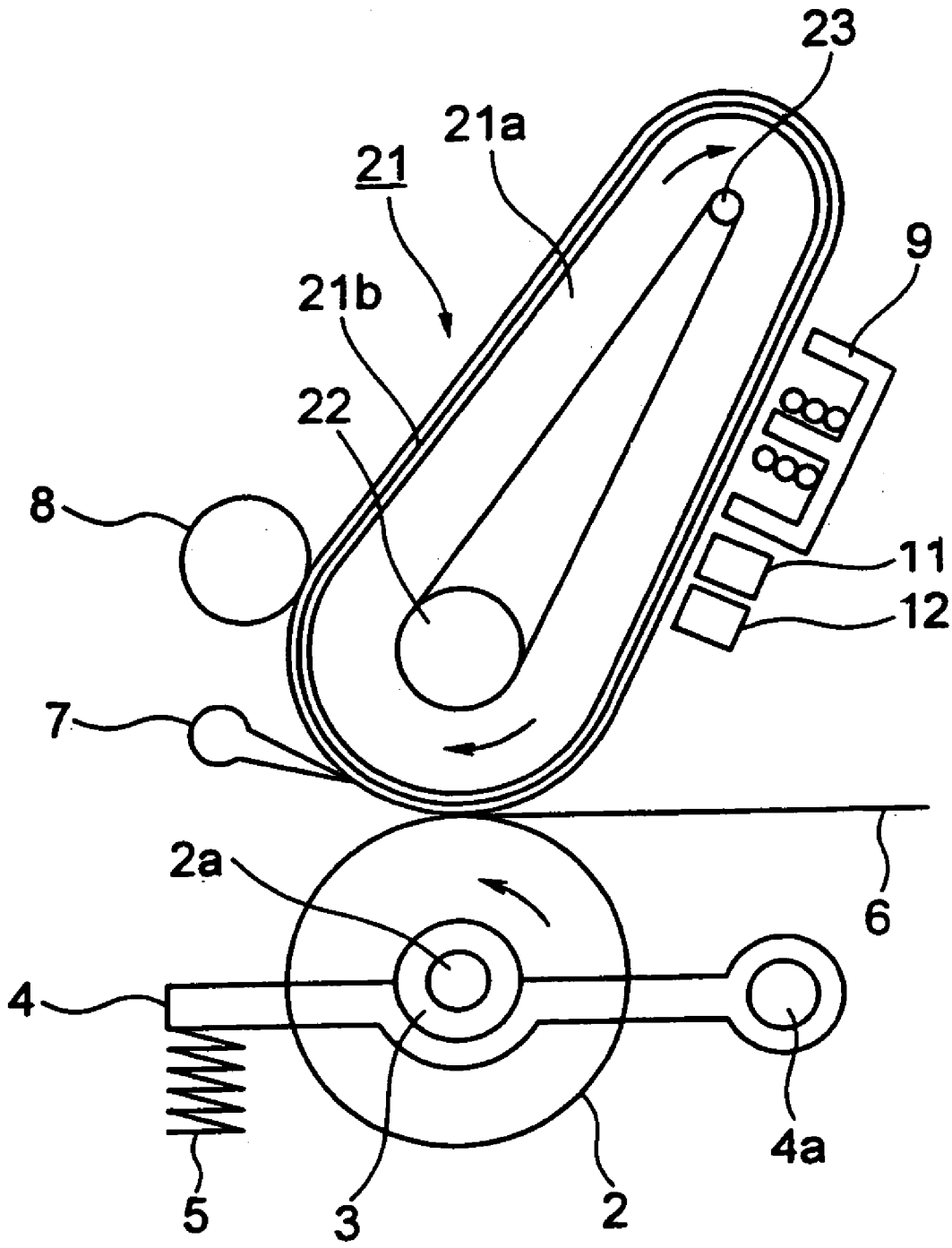
FIG. 9 is a schematic front view showing a principal part in a structure of a fixing device according to a further variation of the embodiment of the present invention shown in FIG. 2.

FIG. 9 is a schematic view showing a variation of the fixing device shown in FIG. 2 and the same reference numerals are used for the same elements and their detailed explanation will be omitted.

According to the embodiment, the heating means is not the roller shown in FIG. 2 but a belt 21. This belt 21 is composed of a belt 21*a* made of flexible material such as rubber and a metal belt formed thereon. This belt 21 is hung between a driving axis 23 and driven axis 22.

In FIG. 9, the driving axis 23 is provided in a right upper position from the driven axis 22, and the induction heating device 9, thermostat 11 and the non-contact temperature detector 12 are provided along the direction from the driving axis 23 to the driven axis 22. The height relation among the thermostat 11 and the non-contact temperature detector 12 and the driven axis 22 is similar to that shown in FIG. 2, namely, they are disposed in the region higher than the center position of the driven axis 22 and within 45 a degree range with the center position being the reference.

Figure 10:
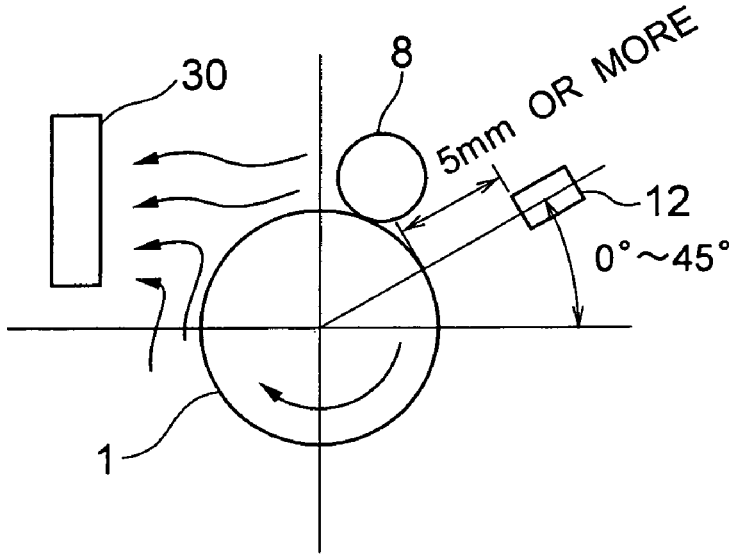
FIG. 10 is an explanatory diagram showing a fundamental structure of the fixing device according to a further embodiment of the present invention.
Figure 11:
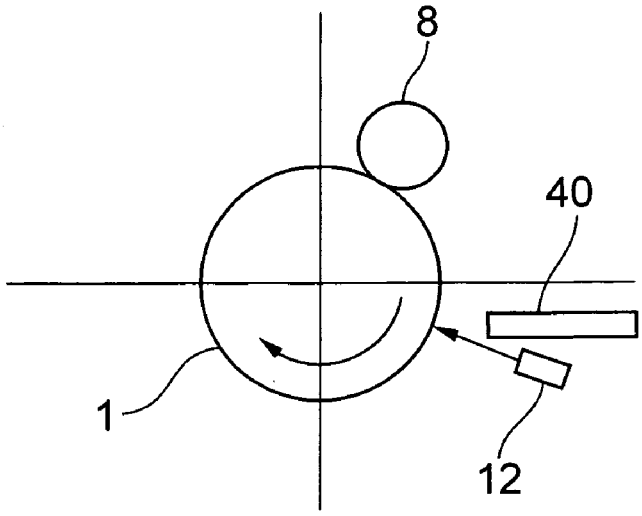
FIG. 11 is an explanatory diagram showing a fundamental structure of the fixing device according to a still further embodiment of the present invention.

FIGS. 10 and 11 are schematic diagrams showing a further embodiment of the fixing device by employing a different resolution from that used in the previous embodiments.

Referring to FIG. 10, it is similar to the embodiment shown in FIGS. 2 and 8 in that the non-contact temperature detector 12 is disposed in a range of 45 degrees higher than the plane running through the center position of the heating roller 1 and separated by 5 mm or more from the surface of the heating roller 1, and at the downstream side of the cleaning roller 8. However, the unique feature is that a fan 30 is used to forcibly keep the convection generated due to the heating by the heating roller 1 away from the non-contact temperature detector. This fan is an example of a heat convection direction changing means.

The setting of the fan 30 is preferably a position symmetrical with the non-contact temperature detector 12 with the heating roller as the center, because the heat convection will be inhaled efficiently.

In this embodiment, though the fan is an example of the heat convection direction changing means, any means to change flow so the heat convection is not directed to the non-contact temperature detector may be employed. For example, a blowing fan with an appropriate blowing guide used in place of an inhaling fan, or introduction of outside air onto the heating roller using a blowing apparatus will change the direction of heat convection.

Furthermore, the fan can be driven in response to other factors. For example, temperature of the non-contact temperature detector itself is detected, and if the temperature is in a high range, the fan is driven because there is an effect of the heat convection. The number of rotations of the fan can be varied according to, for example, waiting status or paper feeding status.

According to this embodiment, since the direction of the heat convection flow generated by the heating of the heating roller is changed so that the flow is not directed to the non-contact temperature detector, the adverse effect of heat convection to the temperature detection will be eliminated, and quick, stable and precise temperature detection will be realized, and further enhancement of the fixing performance and shortened warm-up time will be accomplished.

FIG. 11 shows a further embodiment in which the disposition of the non-contact temperature detector is different from previous embodiments. Namely, according to the previous embodiments, the non-contact temperature detector is disposed above the plane running through the center of the heating roller, but according to this embodiment, the non-contact temperature detector is disposed on a lower side.

The reason of disposing above in the previous embodiments is that there is a possibility of contamination of the non-contact temperature detector due to falling of toners stuck on the heating roller. But it is considered that there is less effect from the heat convection on the rather in lower side.

According to this embodiment, the non-contact temperature detector is disposed below the plane running through the center of the heating roller and above the temperature detector, and a cover member 40 to prevent toners sticking is provided. If this cover member 40 is made of a material that can magnetically shield and does not generate eddy current in order to prevent the non-contacting temperature detector from heating by itself by the effect of the induction heater, a regular type temperature detector other than the shield type temperature detector shown in FIG. 4 can be employed.

According to this embodiment, since the non-contact temperature detector is disposed in the lower side of the horizontal plane running through the center of the heating roller, and a cover is provided thereabove, if toners fall from the heating roller, their sticking is prevented and the effect of heat convection is eliminated. Accordingly, quick, stable and precise temperature detection are realized and enhancement in the fixing performance and shortened warm-up time will be accomplished.

What is claimed is:

1. An image forming system comprising:

a manuscript image reading device to scan a manuscript and obtain shade information on the manuscript;

an exposure/development device to record a charged latent image in a photosensitive body based on the shade information obtained by said manuscript image reading device, to apply toners to the photosensitive body to transfer the toners to a recording medium;

a fixing device to fix the toners transferred to the recording medium by thermal pressing;

said fixing device having;

a rotational heating member;

a pressing roller for pressing from a bottom of the rotational heating member; and a non-contact temperature detector that is provided above a horizontal surface passing a rotation axis of the rotational heating member and detects a temperature of said rotational heating member; and a fan to direct heat convection generated by said rotational heating member to directions other than the direction of said non-contact temperature detector, wherein heating of the rotational heating member is controlled by a value detected by said non-contact temperature detector, and wherein said fan is disposed in a position symmetrical with the non-contact temperature detector, with the heating roller as a center, and the fan exhausts air flow outwardly.

2. The image forming system according to claim 1, wherein said fan inhales outside air.

3. The image forming system according to claim 1, wherein said non-contact temperature detector is disposed within a range of 45 degrees with a plane running through a rotation axis of said rotational heating member being angle 0 and the rotation axis being the angle center, and is disposed at a position apart from said rotating heating member by 5 mm or more.

4. The image forming system according to claim 3, wherein said non-contact temperature detector is disposed at a position apart from said rotating heating member by 5 mm or more.

5. The image forming system according to claim 1, further comprising cleaning means to clean a surface of said rotational heating member, said cleaning means being provided in an upstream side of the rotation direction of the rotational heating member.

6. The image forming system according to claim 1, wherein said non-contact temperature detector has a structure by which a temperature sensor is shielded by a material having magnetic shielding function.

7. The image forming system according to claim 1, wherein said rotation heating member is a heating roller.

8. The image forming system according to claim 7, wherein said heating roller is heated by induction heating using an induction heating device.

9. The image forming system according to claim 7, wherein said heating roller is heated by a heating ray using a heating ray irradiation means.

10. The image forming system according to claim 9, wherein said heating ray is an infrared ray.

* * * * *